US009420668B2

(12) United States Patent
Sekiya

(10) Patent No.: US 9,420,668 B2
(45) Date of Patent: Aug. 16, 2016

(54) LIGHTING APPARATUS AND ILLUMINATION MANAGEMENT METHOD OF THE SAME

(71) Applicant: DISCO CORPORATION, Tokyo (JP)

(72) Inventor: Kazuma Sekiya, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 14/734,659

(22) Filed: Jun. 9, 2015

(65) Prior Publication Data

US 2015/0359071 A1 Dec. 10, 2015

(30) Foreign Application Priority Data

Jun. 9, 2014 (JP) ..... 2014-118446

(51) Int. Cl.
*H05B 37/02* (2006.01)
*H05B 33/08* (2006.01)

(52) U.S. Cl.
CPC ..... *H05B 37/0227* (2013.01); *H05B 33/08* (2013.01); *H05B 37/0272* (2013.01)

(58) Field of Classification Search
CPC ..... H05B 33/08; H05B 37/02
USPC ..... 315/152, 291, 294, 297, 307, 312; 250/221
See application file for complete search history.

(56) References Cited

U.S. PATENT DOCUMENTS

2003/0067441 A1* 4/2003 Hamana ..... G02B 27/20 345/156
2003/0178554 A1* 9/2003 Zak ..... H04B 10/116 250/221
2008/0203928 A1* 8/2008 Frumau ..... H05B 37/029 315/151
2013/0141011 A1* 6/2013 Fushimi ..... H05B 37/02 315/294
2015/0208485 A1* 7/2015 Nakamura ..... H05B 37/0245 315/291

FOREIGN PATENT DOCUMENTS

JP 2001-056990 2/2001

* cited by examiner

*Primary Examiner* — Tung X Le
(74) *Attorney, Agent, or Firm* — Greer Burns & Crain, Ltd.

(57) ABSTRACT

A lighting apparatus includes a power supply connection section, a light emitter, a switch, a control circuit, and a photoreceptor element. The power supply connection section is connected to a power supply. The light emitter emits light by power supplied from the power supply connection section. The switch is provided in a conductive path from the power supply connection section to the light emitter. The control circuit actuates the switch. The photoreceptor element is connected to the control circuit. The photoreceptor element receives a laser beam from a laser pointer to activate the control circuit so as to turn on or off the switch. The individual light emitters can be illuminated or extinguished simply by irradiating a laser beam from the laser pointer onto the switches. The lighting apparatus can be curtailed and restored to their initial conditions without removing and attaching the apparatus using a stepladder or ladder.

4 Claims, 4 Drawing Sheets

LIGHTING APPARATUS AND ILLUMINATION MANAGEMENT METHOD OF THE SAME

BACKGROUND OF THE INVENTION

1. Field of the Invention

The present invention relates to a lighting apparatus and a method of managing the illumination and extinguishment of the same.

2. Description of the Related Art

A plurality of lighting apparatus are provided in buildings and structures such as offices and factories, ships, and a variety of sports facilities. Each of the plurality of lighting apparatus includes one of a variety of light emitters such as fluorescent lamp, mercury lamp, and LED. Appropriate brightness is achieved by illuminating these lighting apparatus, thus providing a well-managed working environment.

SUMMARY OF THE INVENTION

However, the switch of lighting apparatus provided on a wall is designed to illuminate or extinguish the plurality of lighting apparatus all at once. As a result, the lighting apparatus cannot be illuminated or extinguished individually. In order to curtail the lighting apparatus to use that are provided at an elevated position such as ceiling, for example, to save power, therefore, the lighting apparatus must be removed using a stepladder or ladder, thus involving risk. Further, when the removed lighting apparatus are reattached for restoration to their original positions to stop the curtailed use, a similar problem occurs.

In light of the foregoing, it is an object of the present invention to provide a lighting apparatus that allows for curtailing of lighting apparatus and restoration to the original conditions in a safe manner and a method of managing the illumination of the same.

In accordance with an aspect of the present invention, there is provided a lighting apparatus that includes a power supply connection section, a light emitter, a switch, a control circuit, and a photoreceptor element. The power supply connection section is connected to a power supply. The light emitter emits light by power supplied from the power supply connection section. The switch is provided in a conductive path from the power supply connection section to the light emitter. The control circuit actuates the switch. The photoreceptor element is connected to the control circuit. The photoreceptor element receives a laser beam from a laser pointer, thus activating the control circuit to turn the switch on or off.

It is preferable that a filter should be disposed in the photoreceptor element of the lighting apparatus to pass only light at specific wavelengths.

In accordance with another aspect of the present invention, there is provided a method of managing the illumination of a plurality of lighting apparatus provided in buildings and structures. The management method includes a selection step of selecting the lighting apparatus to be illuminated and those to be extinguished. The management method further includes a lighting apparatus curtailing or restoring step of irradiating light onto a photoreceptor element of each of the lighting apparatus selected in the selection step using a laser pointer so as to activate a control circuit and turn off or on a switch.

In the present invention, each of the lighting apparatus includes a switch, a control circuit, and a photoreceptor element. The switch is connected to a light emitter. The control circuit actuates the switch. The photoreceptor element is connected to the control circuit. The photoreceptor element receives a laser beam from a laser pointer, thus activating the control circuit to turn the switch on or off. This allows the lighting apparatus to be illuminated or extinguished individually.

Therefore, the light emitters can be curtailed simply by irradiating a laser beam from the laser pointer onto the switches, thus eliminating the need to remove the lighting apparatus using a stepladder or ladder and ensuring safety in curtailing lighting apparatus.

Similarly, the curtailed lighting apparatus can be illuminated simply by irradiating a laser beam from the laser pointer onto the switches, thus restoring the lighting apparatus to their initial conditions in a safe manner without using a stepladder or ladder.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
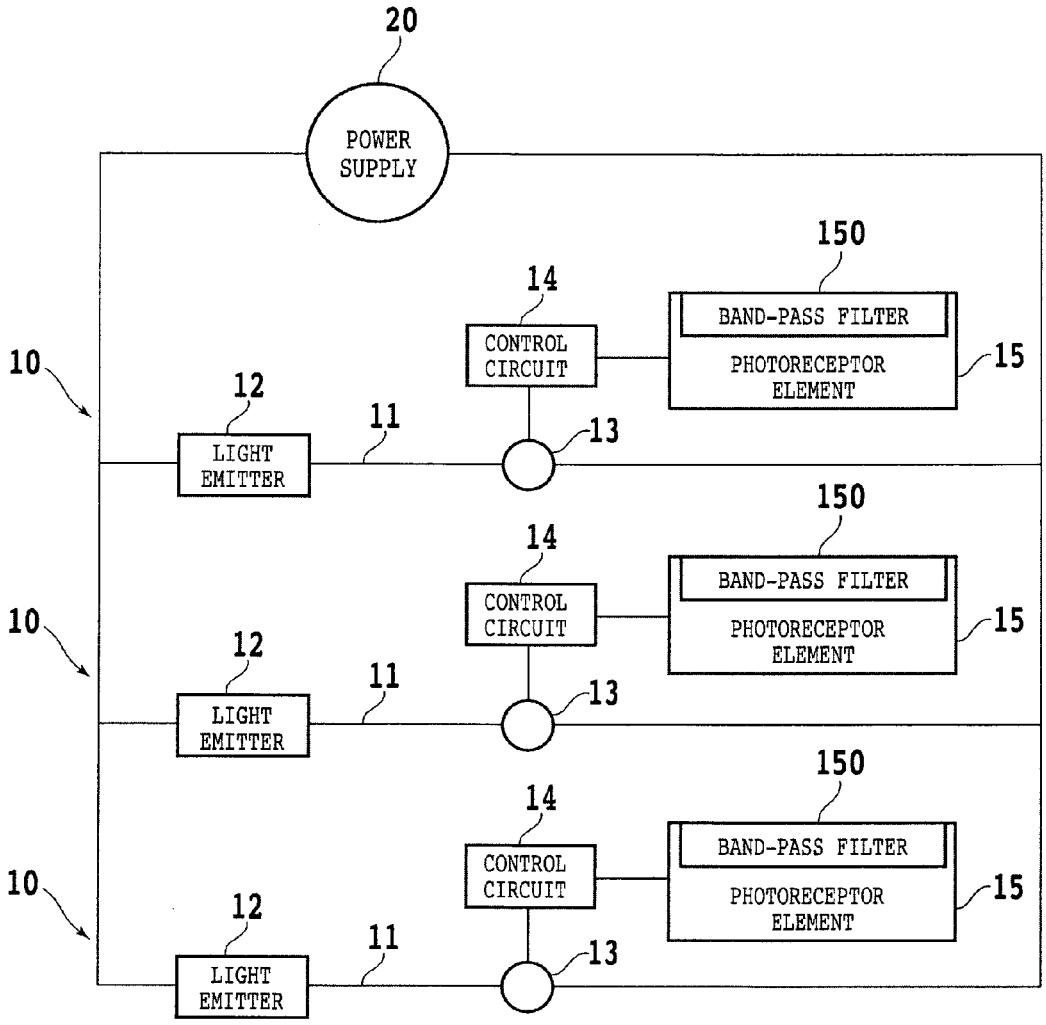
FIG. 1 is a block diagram illustrating a configuration of a lighting apparatus.

A plurality of lighting apparatus 10 shown in FIG. 1 are provided in buildings and structures. Each of the plurality of lighting apparatus 10 includes a power supply connection section 11, a light emitter 12, a switch 13, a control circuit 14, and a photoreceptor element 15. The power supply connection section 11 is connected to a power supply 20. The light emitter 12 emits light by power supplied from the power supply connection section 11. The switch 13 is provided in a conductive path from the power supply connection section 11 to the light emitter 12. The control circuit 14 actuates the switch 13. The photoreceptor element 15 is coupled to the control circuit 14. In the example of FIG. 1, the three lighting apparatus 10 are shown. However, only the two lighting apparatus 10 may be provided in some cases, and the four or more lighting apparatus 10 may be provided in other cases.

The power supply connection sections 11 are connected in parallel to the power supply 20 and each thereof has one end connected to the light emitter 12. The light emitter 12 is, for example, a fluorescent lamp or LED and provided at an elevated position such as ceiling. Each of the light emitters 12 is connected to one of the switches 13. That is, the switches 13 are associated with the light emitters 12 in a one-to-one relationship. When the switch 13 turns on, power is supplied from the power supply 20 via the power supply connection section 11, thus causing the light emitter 12 to emit light. When the switch 13 turns off, power from the power supply 20 is interrupted, thus causing the light emitter 12 to stop emitting light.

The control circuit 14 is connected to each of the switches 13, thus allowing the switch 13 to be turned on or off with a signal output from the control circuit 14. The switches 13 are associated with the control circuits 14 in a one-to-one relationship. This makes it possible to turn on or off the switches individually.

Each of the control circuits 14 adapted to turn on or off one of the switches 13 is connected to the photoreceptor element 15. The photoreceptor element 15 is, for example, a photosensor and includes a band-pass filter 150 adapted to pass only laser beam at given wavelengths. When a laser beam at one of the given wavelengths is received, the photoreceptor element 15 transmits a signal to the control circuit 14, thus activating the control circuit 14. Then, the control circuit 14 outputs a signal to the switch 13, thus turning on or off the switch 13.

Figure 2A:
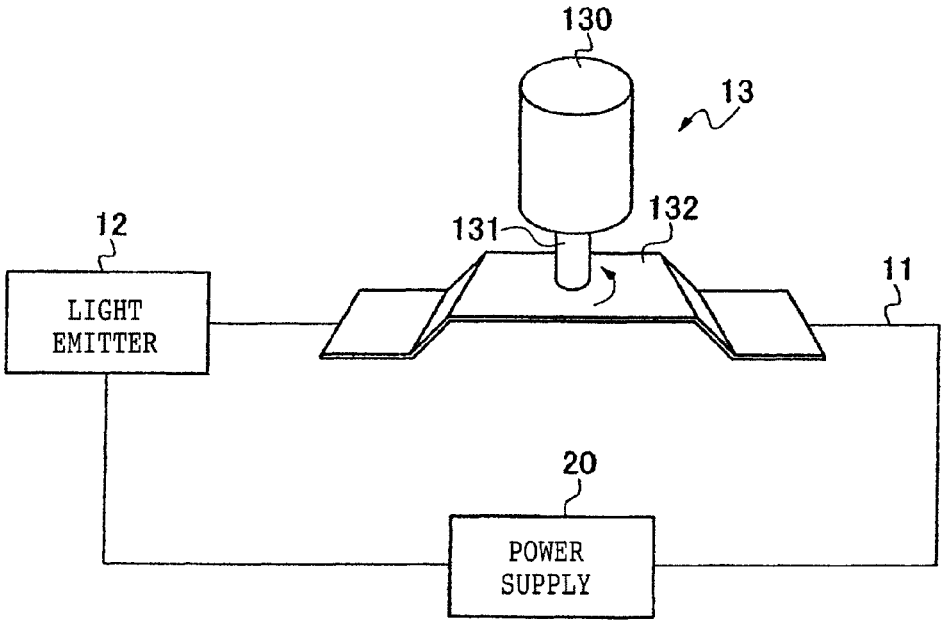
FIG. 2A is a perspective view illustrating a switch in an on state.
Figure 2B:
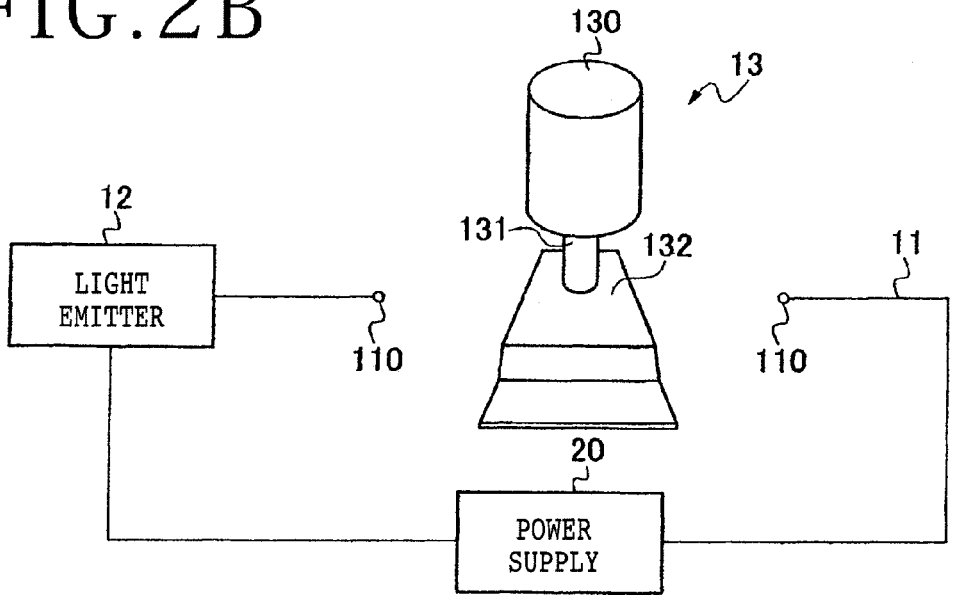
FIG. 2B is a perspective view illustrating the switch in an off state.

As illustrated in FIGS. 2A and 2B, the switch 13 includes a motor 130 and a contact piece 132. The motor 130 is driven by the control circuit 14. The contact piece 132 is attached to the tip of a rotating shaft 131 of the motor 130. The upper end of the contact piece 132 is fastened to the tip of the rotating shaft 131 so that the contact piece 132 rotates with the rotation of the rotating shaft 131. The motor 130 can be switched between a conducting state shown in FIG. 2A and a non-conducting state shown in FIG. 2B by rotating the rotating shaft 131 by 90 degrees at a time. Here, the term "conducting state" refers to a condition in which the light emitter 12 emits light as a result of connection between the power supply connection section 11 and the light emitter 12, and the term "non-conducting state" refers to a condition in which the light emitter 12 does not emit light as a result of disconnection between the power supply connection section 11 and the light emitter 12. In the conducting state, there is continuity between the power supply connection section 11 and the light emitter 12 as a result of contact between the two end portions of the contact piece 132 with contacts 110 of the power supply connection section 11. In the non-conducting state, on the other hand, the power supply connection section 11 and the light emitter 12 are disconnected from each other because the contacts 110 are not in contact with the contact piece 132.

A description will be given next of a method of managing the illumination of the lighting apparatus 10 configured as described above with reference to FIGS. 3 and 4.

(1) Selection Step

Figure 3:
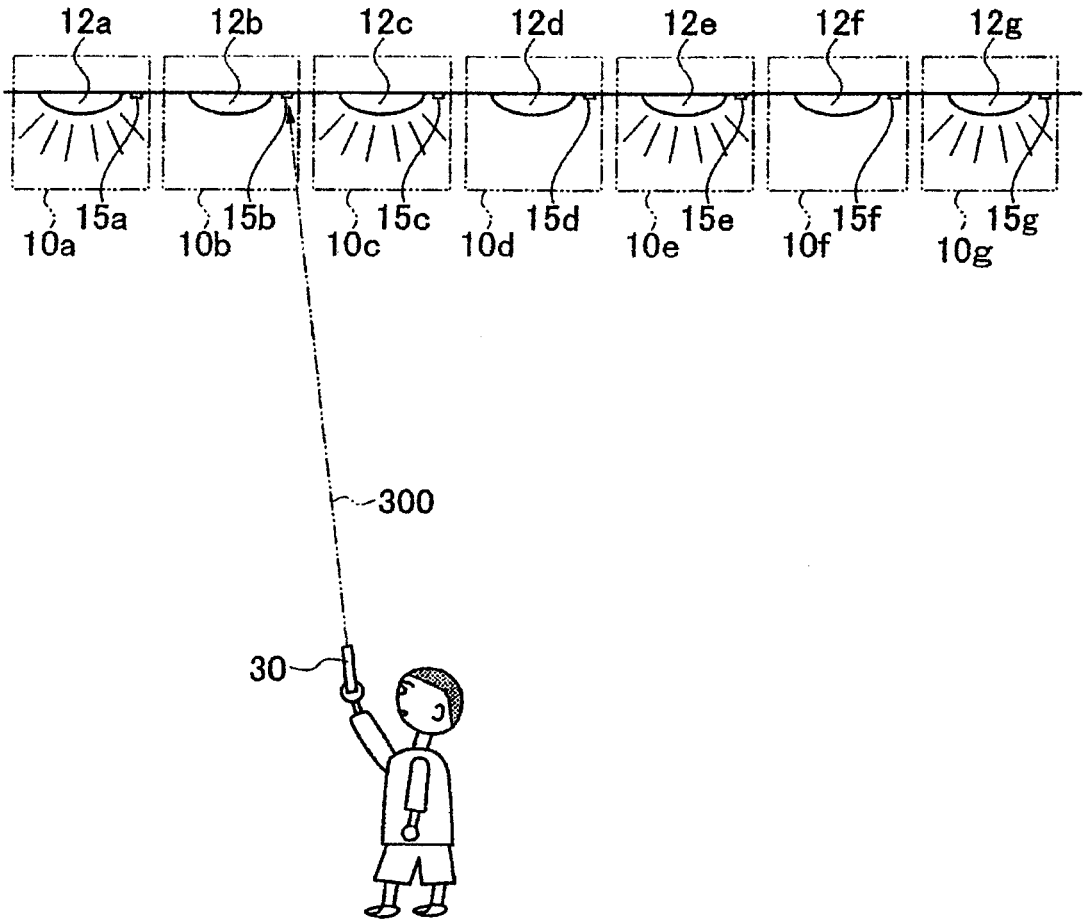
FIG. 3 is a front view illustrating the manner in which the lighting apparatus are curtailed by irradiating a laser beam onto photoreceptor elements.

For example, if lighting apparatus 10*a*, 10*b*, 10*c*, and so on up to 10*g* are installed to the ceiling as illustrated in FIG. 3, an operator selects which of these lighting apparatus to illuminate and others to extinguish. For example, if the operator wishes to extinguish the lighting apparatus 10*b*, 10*d*, and 10*f* for curtailed use, he or she selects the lighting apparatus 10*b*, 10*d*, and 10*f* as the ones to be extinguished. On the other hand, the operator leaves the lighting apparatus 10*a*, 10*c*, 10*e*, and 10*g* illuminated.

(2) Curtailing the Lighting Apparatus

Next, the operator points a laser pointer 30 to photoreceptor elements 15*b*, 15*d*, and 15*f* of the selected lighting apparatus 10*b*, 10*d*, and 10*f*, respectively, and irradiates a laser beam 300 thereonto as illustrated in FIG. 3. This laser beam 300 has a wavelength that passes through the band-pass filters 150 (refer to FIG. 1) of the photoreceptor elements 15*b*, 15*d*, and 15*f*. A laser beam at a wavelength of 532 nm is used, for example, as the laser beam 300, with the band-pass filter 150 set to pass a range of wavelengths from 530 nm to 540 nm. Laser beams travel in a highly straight manner. This makes it possible to irradiate the laser beam onto the desired photoreceptor elements.

Figure 4:
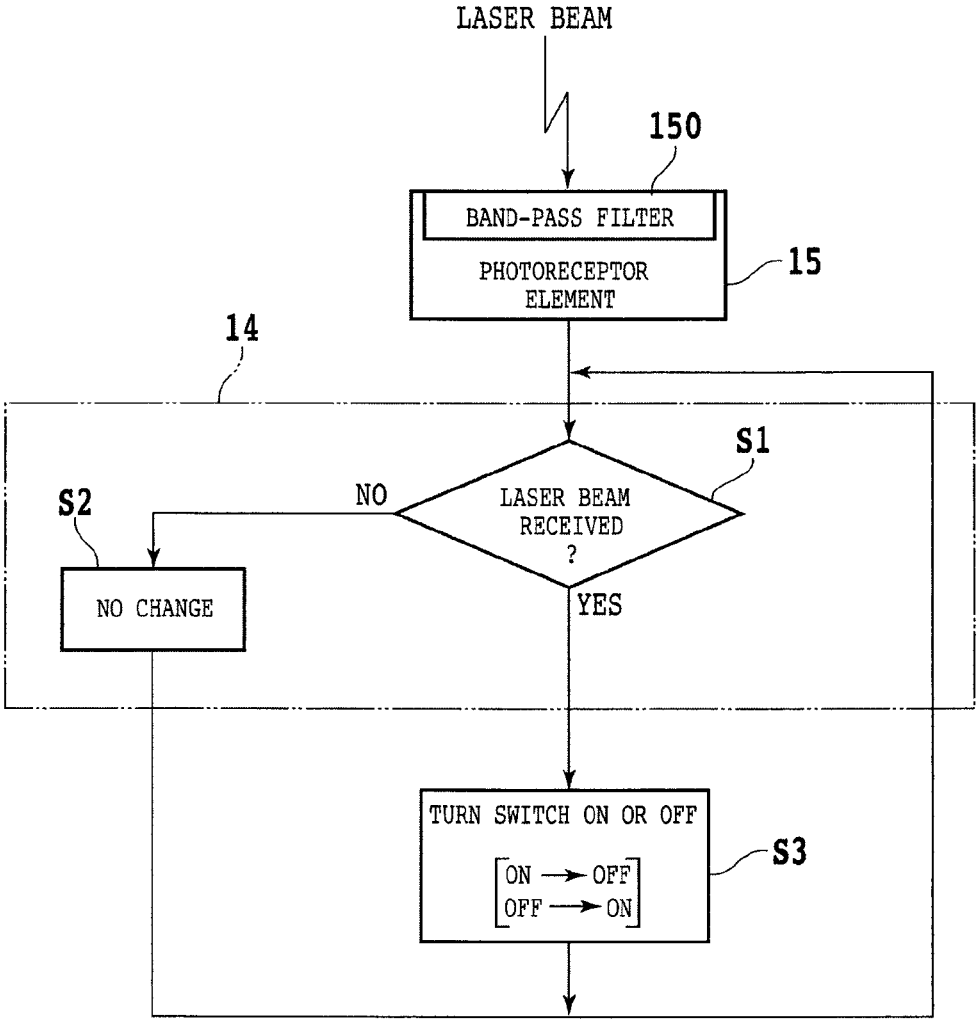
FIG. 4 is a flowchart illustrating an illumination management method of the lighting apparatus.

The photoreceptor elements 15*b*, 15*d*, and 15*f* perform a process appropriate to whether or not a laser beam that has passed through the band-pass filter 150 has been received (step S1 in FIG. 4). If no laser beam has been received, no process is performed, causing no change to take place. That is, the control circuit 14 shown in FIG. 1 is not activated (step S2 in FIG. 4).

On the other hand, when the photoreceptor element 15 receives a laser beam, this photoreceptor element transmits a signal to that effect to the control circuit 14. As a result, the control circuit 14 is activated, thus rotating the contact piece 132 of the motor 130 of the switch 13 shown in FIG. 2 by 90 degrees (step S3 in FIG. 4). The rotation of the contact piece 132 by 90 degrees removes continuity between light emitters 12*b*, 12*d*, and 12*f* and the power supply connection section 11, switching the motor 130 from the conducting state to the non-conducting state and interrupting supply of power to the light emitters 12*b*, 12*d*, and 12*f*. As a result, the light emitters 12*b*, 12*d*, and 12*f* stop emitting light, thus extinguishing the lighting apparatus 10*b*, 10*d*, and 10*f*.

As described above, the desired lighting apparatus can be curtailed simply by irradiating a laser beam from the laser pointer 30 onto each of the photoreceptor elements, thus eliminating the need to remove the lighting apparatus using a stepladder or ladder.

Further, when stopping the curtailed use, the operator irradiates a similar laser beam from the laser pointer 30 onto the photoreceptor elements 15*b*, 15*d*, and 15*f* as in the case where the lighting apparatus are extinguished. This activates the control circuit 14, thus rotating the contact piece 132 of the motor 130 of the switch 13 shown in FIG. 2 by 90 degrees (step S3 in FIG. 4). The rotation of the contact piece 132 by 90 degrees provides continuity between light emitters 12*b*, 12*d*, and 12*f* and the power supply connection section 11, switching the motor 130 from the non-conducting state to the conducting state and resuming supply of power to the light emitters 12*b*, 12*d*, and 12*f*. As a result, the light emitters 12*b*, 12*d*, and 12*f* emit light, thus illuminating the lighting apparatus 10*b*, 10*d*, and 10*f*. Therefore, the curtailed lighting apparatus can be restored to their initial conditions without using a stepladder or ladder in a safe manner.

It should be noted that the lighting apparatus 10 according to the present invention can be used for purposes other than curtailing lighting apparatus. For example, if the screen of a personal computer or other device is projected onto a screen using a projector, the room should be darkened to a certain extent. In this case, the room can be finely adjusted to proper brightness by extinguishing the individual lighting apparatus with a laser pointer. Further, the laser pointer used to illuminate or extinguish the lighting apparatus can also be conveniently employed to point to a specific area of the screen projected onto a screen.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A lighting apparatus comprising:

a power supply connection section connected to a power supply;

a light emitter adapted to emit light by power supplied from the power supply connection section;

a switch provided in a conductive path from the power supply connection section to the light emitter, wherein the switch includes a motor with a rotating shaft and a contact piece attached to the rotating shaft for rotation therewith;

a control circuit adapted to actuate the switch by rotating the rotating shaft of the motor such that the contact piece is rotated; and a photoreceptor element connected to the control circuit, wherein the photoreceptor element receives a laser beam from a laser pointer to activate the control circuit so as to turn on or off the switch.

2. The lighting apparatus of claim 1, wherein the photoreceptor element has a band-pass filter adapted to pass only light at given wavelengths.

3. A method of managing the illumination of a plurality of lighting apparatus provided in buildings and structures, each of the plurality of lighting apparatus including:

a power supply connection section connected to a power supply, a light emitter adapted to emit light by power supplied from the power supply connection section, a switch provided in a conductive path from the power supply connection section to the light emitter, wherein the switch includes a motor with a rotating shaft and a contact piece attached to the rotating shaft for rotation therewith, a control circuit adapted to actuate the switch by rotating the rotating shaft of the motor such that the contact piece is rotated, and a photoreceptor element connected to the control circuit, the management method comprising:

a selection step of selecting the lighting apparatus to be illuminated and the lighting apparatus to be extinguished; and a lighting apparatus curtailing or restoring step of irradiating a laser beam onto the photoreceptor element of each of the lighting apparatus selected in the selection step using a laser pointer so as to activate the control circuit and turn off or on the switch.

4. A method of managing the illumination of a plurality of lighting apparatuses provided at an elevated position in a building or other structure to reduce power consumption, each of the plurality of lighting apparatus including:

a power supply connection section connected to a power supply, a light emitter adapted to emit light by power supplied from the power supply connection section, a switch provided in a conductive path from the power supply connection section to the light emitter, wherein the switch is provided for each associated lighting apparatus and is provided at an elevated position, adjacent the associated light apparatus, a control circuit adapted to actuate the switch, and a photoreceptor element connected to the control circuit, the management method comprising:

a selection step of selecting the lighting apparatuses to be individually extinguished, in order to reduce power consumption, while maintaining other lighting apparatuses illuminated; and a lighting apparatus curtailing step of irradiating a laser beam onto the photoreceptor element of each of the lighting apparatuses selected in the selection step using a laser pointer so as to activate the control circuit and turn off the switch.

* * * * *